United States Patent [19]

Thum, III et al.

[11] Patent Number: 4,776,135

[45] Date of Patent: Oct. 11, 1988

[54] SYSTEM FOR DEBURRING OF ARTICLES

[75] Inventors: Elwood F. Thum, III, 229 Fenimore La., Delanco, N.J. 08075; Richard H. Fontaine, Enfield, Conn.

[73] Assignee: Elwood F. Thum, III, Delanco, N.J.

[21] Appl. No.: 3,593

[22] Filed: Jan. 15, 1987

[51] Int. Cl.[4] ..... B24B 31/033

[52] U.S. Cl. ..... 51/164.2

[58] Field of Search ..... 51/164.1, 164.2, 163.2

[56] References Cited

U.S. PATENT DOCUMENTS

| | | | |
|---|---|---|---|
| Re. 30,977 | 6/1982 | Zecher . | |
| 2,918,758 | 12/1959 | Barnes . | |
| 3,013,365 | 12/1961 | Harper . | |
| 3,187,473 | 6/1965 | Ruppe . | |
| 3,230,671 | 1/1966 | Rampe . | |
| 3,233,372 | 2/1966 | Kobayashi . | |
| 3,341,979 | 9/1967 | Davidson | 51/164.2 |
| 3,441,968 | 5/1969 | Kramen . | |
| 3,489,354 | 1/1970 | Harper . | |
| 3,503,157 | 3/1970 | Harper . | |
| 3,680,266 | 8/1972 | Shiplov . | |
| 3,765,127 | 10/1973 | Garlinghouse . | |
| 4,104,831 | 8/1978 | Kobayashi | 51/164.2 |
| 4,172,339 | 10/1979 | Balz | 51/164.2 |
| 4,308,693 | 1/1982 | Harper . | |
| 4,363,194 | 12/1982 | Balz . | |
| 4,385,472 | 5/1983 | Balz . | |
| 4,387,537 | 6/1983 | Roach . | |
| 4,581,855 | 4/1986 | Kobayashi et al. | 51/164.2 |
| 4,586,292 | 5/1986 | Carroll | 51/164.2 |

FOREIGN PATENT DOCUMENTS 2617723 11/1977 Fed. Rep. of Germany ..... 51/164.2

*Primary Examiner*—Robert P. Olszewski

*Attorney, Agent, or Firm*—William H. Eilberg

[57] ABSTRACT

The invention includes a method and apparatus for automatic deburring of articles. The articles are placed in a barrel which is rotated so that the articles are deburred by centrifugal force. The barrel experiences two degrees of rotation. It rotates about its own axis, and it is also mounted on a rotating table. The table rotates in the opposite direction, and, in general, at a different speed, from that of the barrel. Separate motors rotate the barrel and the table independently. A releasable latch mechanism holds the barrel to the table. The table holds at least two barrels at once. The invention also provides a system which fully automates the deburring operation, and which is capable of processing a large quantity of articles with virtually no human intervention. The system includes conveyor and handler mechanisms which transport barrels between a filling station, a centrifugal deburring station, and a dumping station. While the articles in one pair of barrels are being deburred, the deburred articles which were processed in a previous cycle are dumped into a suitable collector, and the emptied barrels are filled with fresh articles to be deburred. The system can also include two centrifugal deburring mechanisms, with a total of at least four barrels. Articles can be delivered to and from one pair of barrels while the other pair of barrels is still rotating.

7 Claims, 13 Drawing Sheets

SYSTEM FOR DEBURRING OF ARTICLES

BACKGROUND OF THE INVENTION

This invention relates to the field of deburring of articles, and provides an improved and automated system for performing the deburring operation.

It has long been known that articles of many shapes and sizes can be deburred by placing them in a barrel, or other container, and by spinning the barrel. Preferably, an abrasive medium is added to the barrel, and the centrifugal force acting between the articles and the medium, and the walls of the container, remove the burrs or "flashing" on the articles. One example of this general method is shown in U.S. Pat. No. 3,013,365.

It has also been known that the deburring process is made more efficient when the container is rotated in two directions at once. That is, the container is rotated around its own axis, and the table on which the container is mounted also rotates, but in the opposite direction. The effect of these rotations is a more thoroughly deburred product. Examples of this kind of centrifugal deburring are shown in U.S. Pat. Nos. 3,503,157 and 4,308,693.

The table which holds the barrel of articles to be deburred typically rotates at about 100 rotations per minute (rpm), and the container rotates about its own axis at about 25 rpm. In many cases, the articles will be deburred after about 20–30 minutes of rotation. The amount of time required to debur the articles depends upon the nature of the articles. This time period can sometimes be as short as about 10 minutes, or as long as several hours.

In the prior art, the table and the barrel are geared, or otherwise linked, such that the ratio of the speed of rotation of the barrel to that of the table is constant.

A major constraint in the operation of centrifugal deburring systems of the prior art is the time required to move the articles into and out of the system. In the systems of the prior art, the barrels cannot be removed from the rotating table. Instead, the articles to be deburred are poured into the barrels as they sit on the table. The barrels have bottoms which can open, to allow the finished products to leave the machine. The barrels must remain stopped while both barrels are being unloaded.

Moreover, the process of reloading the barrels is very time consuming. First, the articles to be deburred, as well as one or two kinds of abrasive media, must be separately delivered to the barrels. Then a measured quantity of water, which can be up to 50 gallons, is poured into the barrels. These operations take time, especially when two or more barrels must be filled. Clearly, the system cannot rotate during the filling. During loading and unloading, the deburring system is, in effect, disabled. Thus, in the prior art, the overall speed of the system has depended critically on the efficiency of the loading and unloading.

The present invention avoids the problem discussed above by providing a centrifugal deburring apparatus having removable barrels. The device of the present invention includes a latch mechanism with which a barrel can be attached to the table, and which permits the barrel to be easily removed from the table when deburring is complete. The contents of the barrel can be quickly removed and processed elsewhere, while another barrel of articles can be placed on the table for centrifugal deburring. The present invention therefore achieves substantial savings of time in the deburring of articles, and can process far more articles, in a given time, than all known systems of the prior art.

The present invention also has the advantage that it is automated. The system operates under the control of a computer, which guides all of the moving parts. While a given barrel is being rotated on the table, the contents of another barrel can be dumped into a collector, and still another barrel can be filled with new articles to be deburred. Moreover, the system can operate with more than one rotating table. The timing of the system is chosen such that one table is rotating while the barrels on the other table are being loaded or unloaded. This automatic operation adds to the efficiency of the system, in contrast with the devices of the prior art.

The present invention also provides a much greater choice of speeds of rotation, as compared with systems of the prior art. The barrel and the table can be rotated at any selected speeds, because they are driven by independent motors.

SUMMARY OF THE INVENTION

At the heart of the present invention is a centrifugal drive mechanism for deburring of articles. A rotatable table is fitted with means for receiving two or more barrels. The barrels are not part of the table, but are removably attachable to the table by a latch mechanism.

The barrels are rotated about their own axes by a first drive motor connected to a gear which drives both barrels at once. A second drive motor is connected, by a suitable gear, to the table itself, and causes the table to rotate in the opposite direction from that of the barrels. The barrels and the table are independently controlled, so one can achieve any ratio between the speed of rotation of the barrels, and the speed of rotation of the table.

The latch mechanism includes a pilot latch member which is connected to a plurality of secondary latch members disposed around the barrel. The pilot latch member, and the other latch members, are mounted on a rotating member which rotates relative to the table. A latch pin, when extended, engages the pilot latch member, as the barrel rotates, and causes the pilot latch member to pivot. This pivoting motion causes all of the latch members to open or close, depending on the direction of rotation of the barrel. The barrel is thereby released from, or secured to, the table. The pilot latch member is designed such that centrifugal force tends to hold the pilot latch member closed while the barrel is rotating.

The present invention also includes a system for automatic operation of the centrifugal drive mechanism. The system includes a filling station, a dumping station, a conveyor means, and a handler. The handler transports barrels between the deburring device, the conveyor, and the dumping station. The conveyor also transports barrels from the filling station to a position on the conveyor from which the handler can accept the barrels.

The system of the present invention is preferably controlled by a computer, so that virtually no supervision is required. In the preferred embodiment, there are at least four barrels, so that the articles in two of the barrels can be deburred, while the other barrels are being emptied and refilled with fresh articles. Thus, no time is lost while the barrels are being loaded and unloaded.

In the preferred embodiment, there are at least two separate centrifugal deburring units, both of which have at least two barrels. While one unit is rotating, the other unit can be loaded and unloaded. The apparatus is controlled such that the deburring operations on the two units are staggered in time. The system therefore achieves maximum efficiency.

The computer is connected to various sensors and controls placed throughout the system. The positions of the handler and conveyor means are sensed by absolute encoders. The position of the table of the centrifugal deburring unit is determined by a proximity switch or other equivalent device. The computer also monitors and controls the setting of the valves on the hoppers, to control the filling of the barrels.

It is therefore an object of the present invention to provide an improved system for deburring of articles.

It is another object of the invention to provide a centrifugal deburring unit having a rotating table, wherein the barrel containing the articles to be deburred is removable from the table.

It is another object of the invention to increase the quantity of articles which can be processed through a deburring system, per unit of time.

It is another object of the invention to provide a fully automated system for deburring of articles.

It is another object of the invention to provide a system for deburring of articles, wherein the system includes at least two centrifugal deburring units, and wherein one unit can be operated while the other unit is being loaded and unloaded.

It is another object of the invention to provide an improved method for centrifugal deburring of articles.

It is another object to provide a method for deburring articles with virtually no human intervention, and wherein the method achieves substantial savings of time, compared with methods of prior art.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
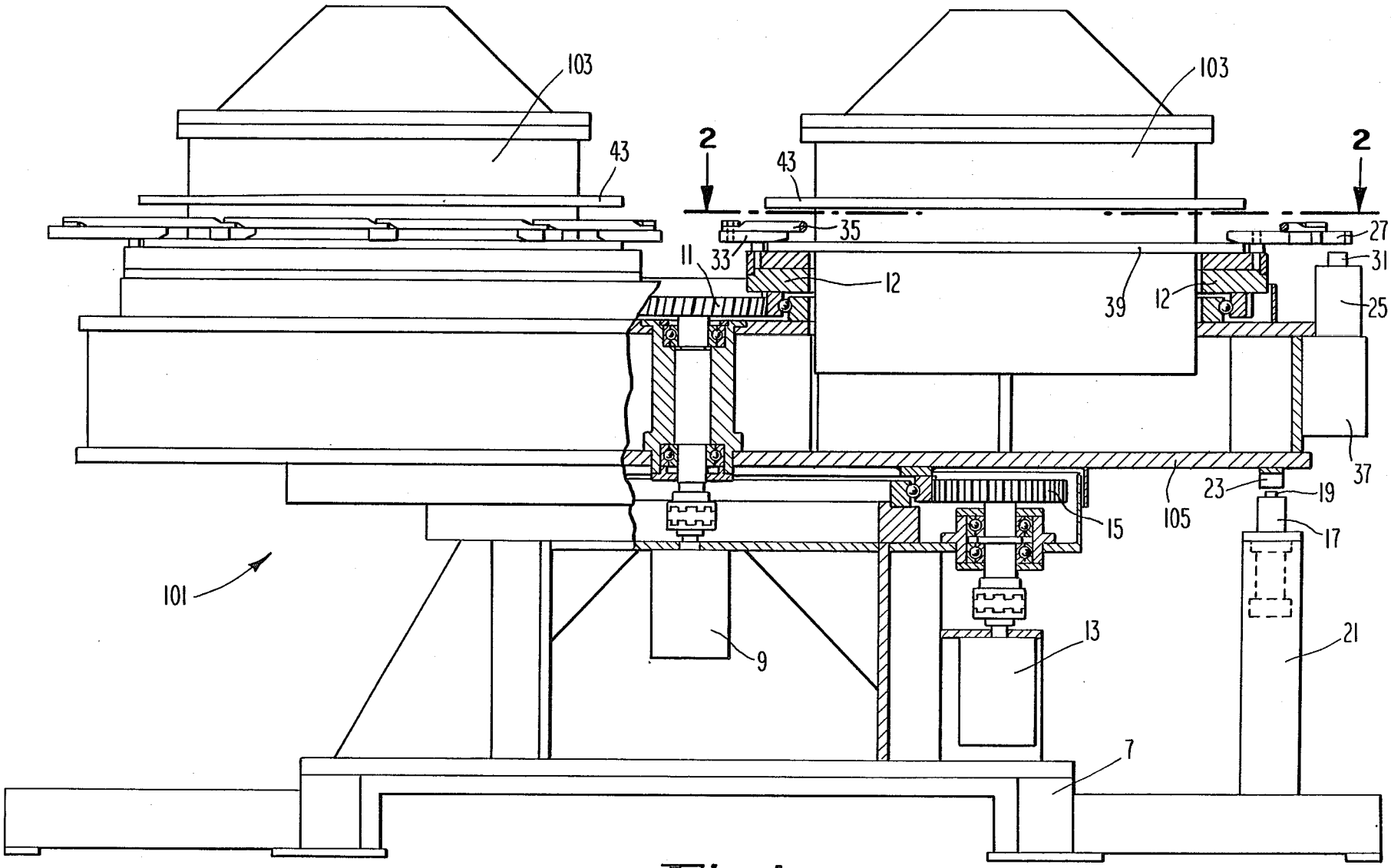
FIG. 1 is a side view, partly in elevation and partly broken away to show a cross-section, taken along the line 1—1 of FIG. 4, and showing the centrifugal deburring unit of the present invention.

The centrifugal deburring unit, which is the most important component of the present invention, is shown in FIG. 1. FIG. 1 is partly a side view, and partly a cross-sectional view. The position of the deburring unit, in relation to the entire system, is shown in the plan view of FIG. 4. Indeed, FIG. 1 is taken along the line 1—1 of FIG. 4. The basic deburring unit will be described first, and the general system will be described later.

Centrifugal deburring unit 101 includes barrels 103, mounted on a rotatable table 105. The table is mounted on frame 7. The barrels rest within rotating members 12, one of which is shown in cross-section in FIG. 1. First drive motor 9 transmits motion to barrels 103 by gear 11, which engages rotating members 12. Rotation of members 12 causes the barrels to rotate, due to friction between the members 12 and the barrels. The barrels are thus both rotated about their own axes, and in the same direction.

Although the deburring unit is shown with two barrels on the table, it is understood that there could be more than two. It is necessary to provide at least two barrels on the table, to provide a counterweight during rotation. However, the counterweight can be an empty barrel, in which case each deburring unit would process only one barrel at a time. The computer control, described below, would be modified accordingly, and this modification is considered within the scope of the invention. It is preferable to use two or more filled barrels, for maximum efficiency.

Second drive motor 13 transmits motion to table 105, through gear 15. The direction of motor 13 is chosen such that the table rotates in the opposite direction from that of the barrels. It is necessary that motor 9 be reversible, because, as explained below, reverse motion is necessary for latching and unlatching the barrels. It is preferable that both motors be operable in either direction, and at variable speeds.

Table locking pin 17, which includes proximity switch 19, is mounted on post 21, and is retractable into the post. Locking pin 17 engages projection 23 on table 105. The purpose of locking pin 17 is to stop the table when it reaches the desired position, and to hold the table in place. The proximity switch signals a microprocessor (described later) to indicate that the table has moved into position. Locking pin 17 can be retracted into post 21 by a motor (not shown), or by any other conventional means.

Figure 2:
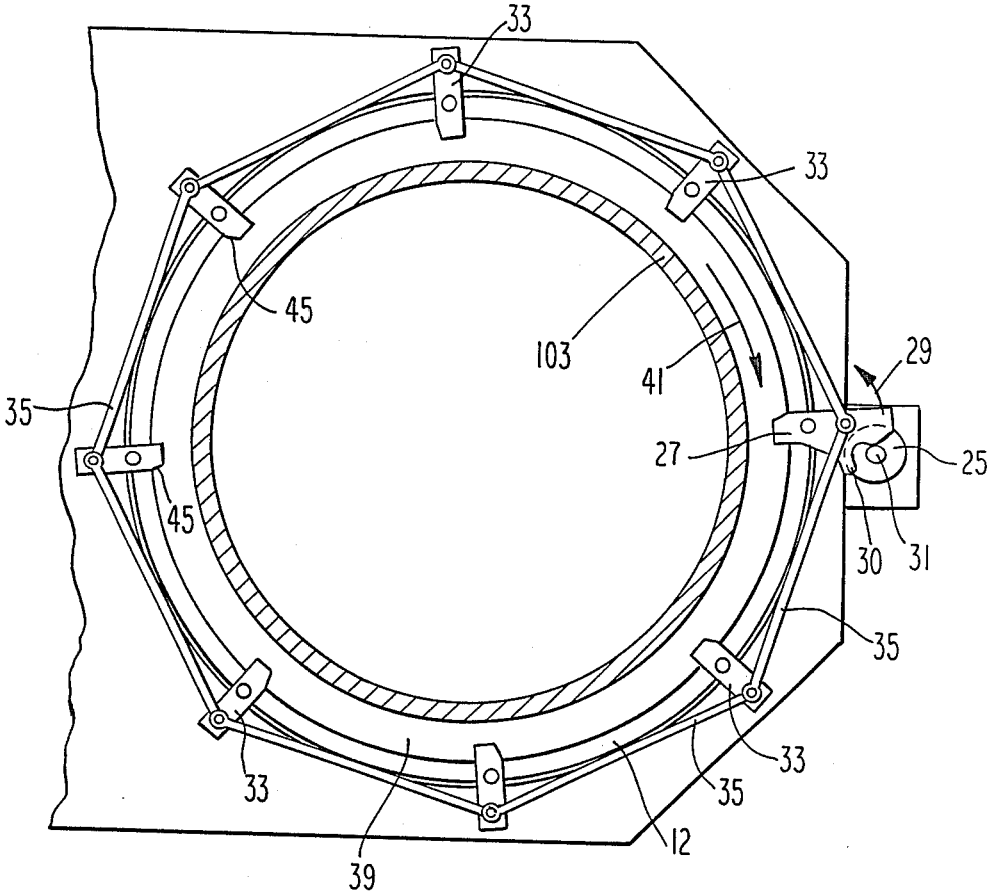
FIG. 2 is a view taken along the line 2—2 of FIG. 1, and shows the latch mechanism of the invention, in the latched position.

Latch pin 25 is mounted on table 105, for engagement with protrusion 30 of pilot latch member 27, as shown in FIG. 2. The latch pin is retractable into housing 37. As shown in FIG. 2, when projection 31 of latch pin 25 is fully extended, and when the barrel is rotating in the direction indicated by arrow 41, the projection engages pilot latch member 27, and causes it to rotate in the direction shown by arrow 29. Due to links 35, secondary latch members 33 rotate similarly, and all of the latch members release flange 39 of barrel 103. The links need not be solid bars, but can be replaced with other equivalent structures, such as chains, within the scope of the invention.

It is understood that there is a separate latch pin for each barrel on the deburring unit. The latch mechanism has not been redrawn for the barrel on the left, in FIG. 1.

The latch pin can also be powered in other ways. For example, it can be pushed by a piston which could be mounted on frame 7, alongside post 21. The latch pin should be mounted to the table, as it must be fixed relative to the axial rotation of the barrel.

Figure 2A:
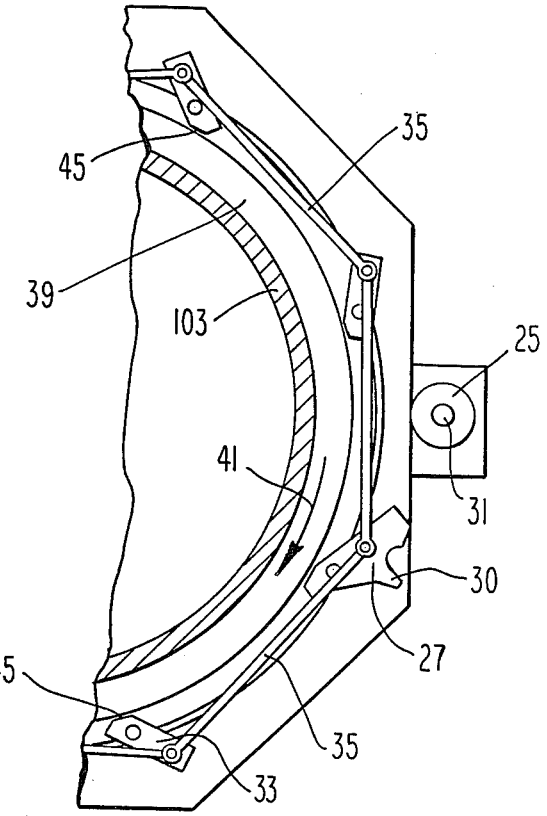
FIG. 2A is a fragmentary view, similar to FIG. 2, showing the latch mechanism in the unlatched position.

FIG. 2A shows the position of the latch members after they have been opened. The barrel is rotating in the direction of arrow 41, and latch pin 25 is extended. Secondary latch members 33 are beveled, as indicated by reference numeral 45, and the bevel makes it easier to release the barrel, as shown in FIG. 2A.

To close the latches, one must simply rotate the barrel in the opposite direction from arrow 41 in FIGS. 2 and 2A, with the latch pin again extended. Engagement of the pilot latch member and the pin causes all the latch members to close. As soon as the latch members have closed, and before the pilot latch member can reach the pin again, the latch pin is retracted. The barrel can then rotate freely without changing the position of the latch members.

Note that the latching operation can be performed in one of two ways, depending on the direction of rotation of the barrels. In the first case, if the main direction of rotation is as shown in FIG. 2, the barrel is latched by extending the latch pin, and then rotating the barrel briefly, and slowly, in the direction opposite that of the main direction of rotation. The latch pin engages the pilot latch member, causing all the latch members to close. The barrel is then stopped, and the latch pin is retracted. The barrel is then made to rotate in the main direction. Because the latch pin has been retracted, the latch members now remain closed during rotation. The barrel is rotated for the desired period at high speed. It is then decelerated, and, during the last rotation, the latch pin is extended, to engage the pilot latch member. The latch members open, as described above, and as shown in FIG. 2.

In the second case, the main direction of rotation of the barrel is opposite to that shown in FIG. 2. In this case, the latches will close as the barrel begins its rotation, due to the momentary extension of the latch pin. Conversely, when the barrel is brought to a stop, the barrel is briefly, and slowly, rotated in the opposite direction, with the latch pin extended, so that the latches will open.

Either of the above procedures can be used where the motors can operate in both directions. As is apparent from the above description of the latching operation, it is necessary that motor 9 be reversible, or that there be some other means of rotating the barrels in both directions.

The pilot latch member is constructed so that it includes a relatively massive piece of material, which, when the latches are closed, is farthest from the center of the barrel. This construction helps hold the pilot latch member closed during rotation, because the massive outer portion tends to stay in its position, due to centrifugal force.

Note that the latch mechanism only prevents the barrel from being lifted from the table, when the latch is set. The latch mechanism does not prevent the barrel from rotating laterally, i.e. from sliding against rotating member 12. The latter movement is prevented by friction between the barrel and the rotating member. Of course, the barrel is fairly heavy, so it is unlikely to slide very much.

Barrel 103 also has a second flange 43 which is used in lifting the barrel from the table, as will be described below.

Figure 3:
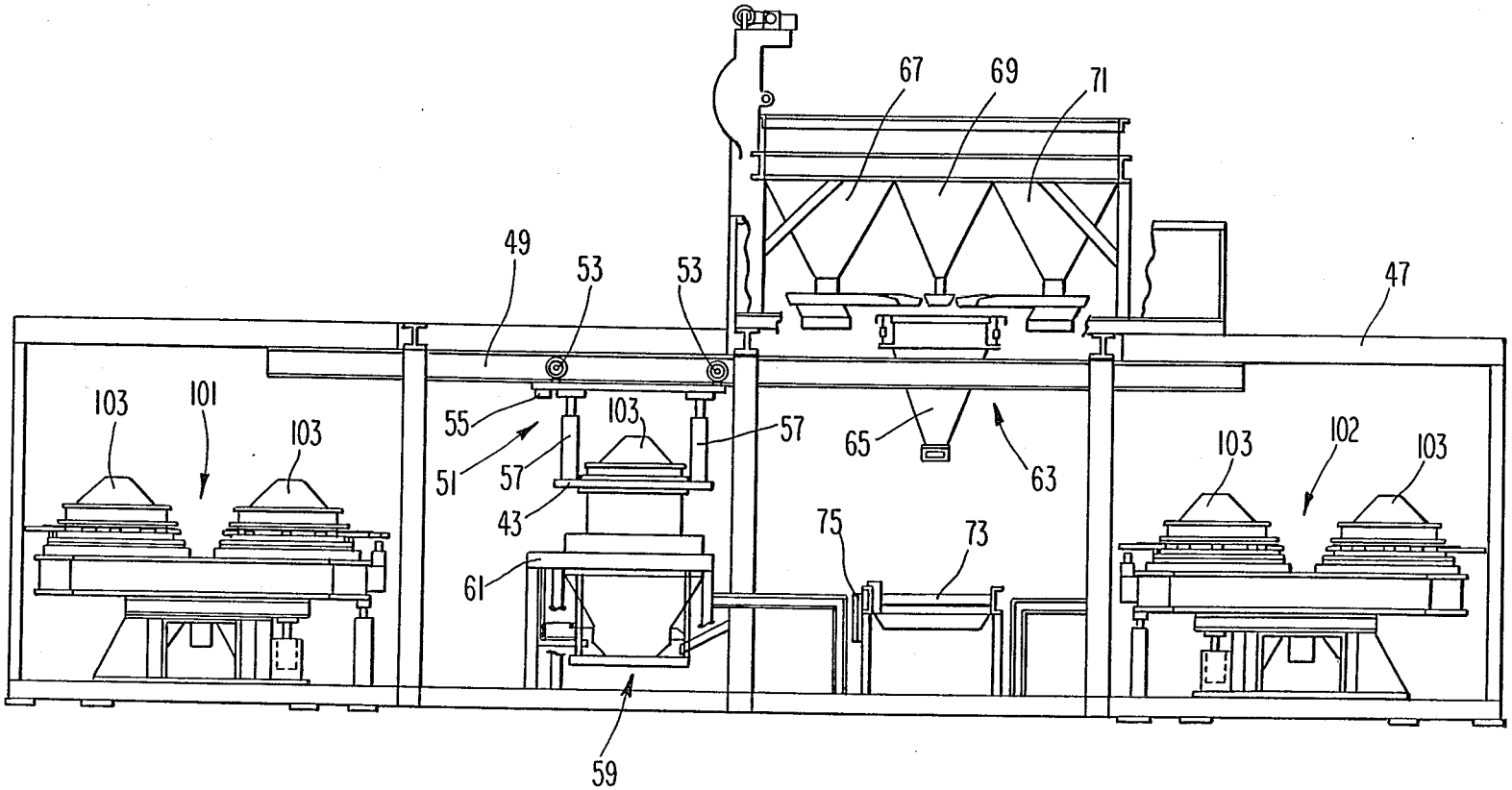
FIG. 3 is a side elevational view of the system of the present invention, showing two centrifugal deburring units, both having two barrels.
Figure 4:
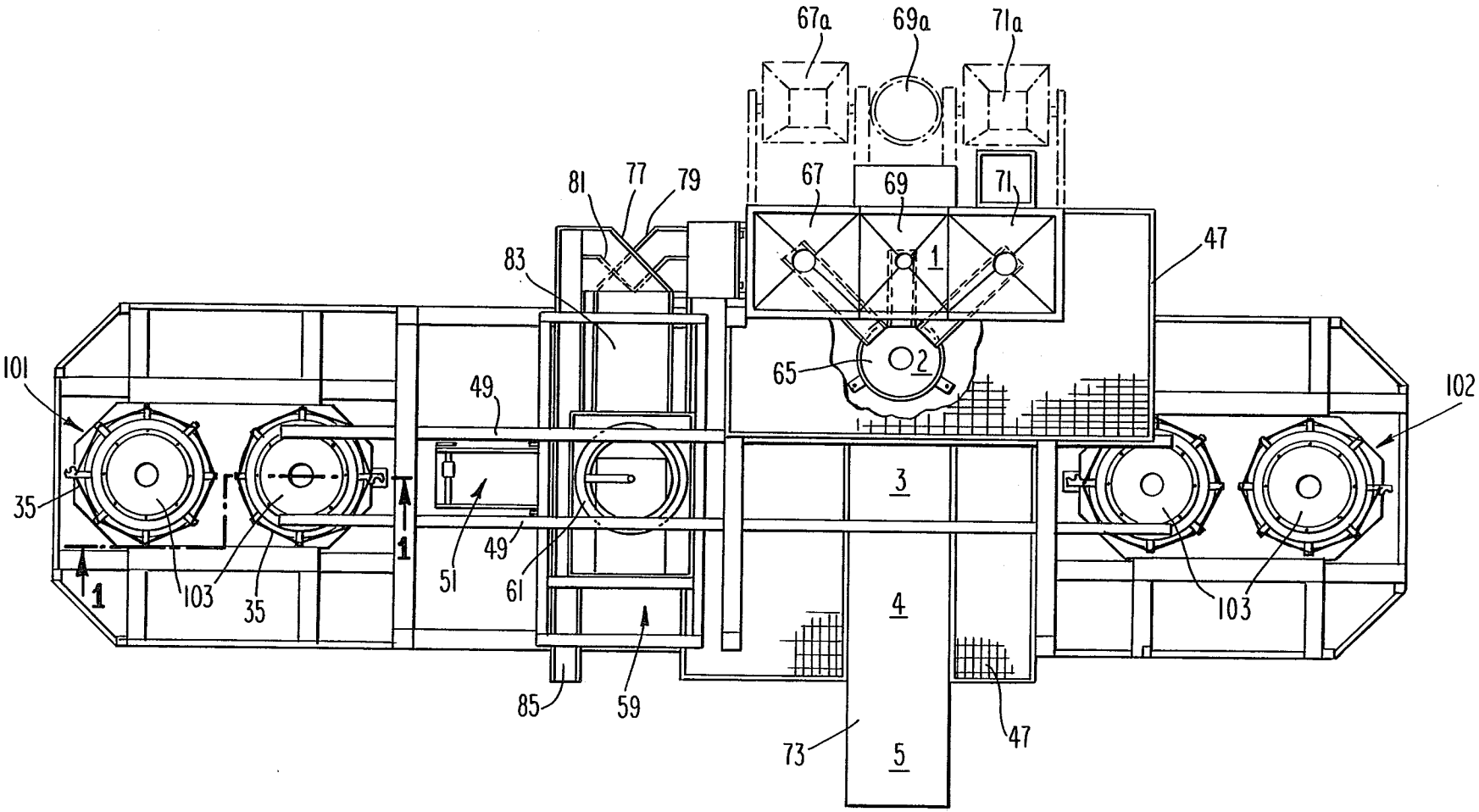
FIG. 4 is a plan view, partly fragmentary, of the system of the present invention.

FIGS. 3 and 4 show the essential parts of the entire system. FIG. 3 is a side view, and FIG. 4 is a top plan view. As shown in these figures, the preferred embodiment comprises two centrifugal deburring units, indicated generally by reference numerals 101 and 102. Both of these units are as shown in FIGS. 1 and 2. They are shown with two barrels each, but it is understood that other numbers of barrels are within the scope of the invention. A change in the number of barrels on a deburring unit would necessitate a change in the programming of the system. The use of only one filled barrel on a deburring unit would, of course, reduce the capacity of the system. The invention is described only with respect to the embodiment as shown.

The system includes a framework 47 which supports track 49. The track can be a conventional I-beam, or it can have any other suitable structure. Handler 51 rides along track 49, by wheels 53. A conventional motor (not shown) moves the wheels, and encoder 55 monitors the angular position of one of the axles of the wheels. The handler includes a pair of arms 57 which are vertically movable. The arms terminate in a suitable clamping or grasping means (not shown in detail). The arms rotate to cause the clamping means to engage flange 43 of barrel 103. Any other suitable means of engagement of the handler and the barrel is possible. It is only necessary that the handler be capable of lifting the barrel from one location, and setting the barrel down at another location.

In FIG. 3, handler 51 is shown at the dumping station, indicated generally by reference numeral 59. The dumping station includes dumper 61, which can simply be a vessel, of sufficient size to receive a barrel, and having a means for locking the barrel therein. The vessel is mounted such that it can be rotated by 180°, so as to empty the contents of the barrel. Any other equivalent structure for the dumper can be used, within the scope of this invention.

FIG. 3 also shows filling station 63. The filling station includes batch hopper 65, which fills a barrel placed beneath it. Feeder hoppers 67, 69, and 71 are disposed above the batch hopper, and are used to fill the batch hopper. One of the feeder hoppers delivers articles to be deburred to the batch hopper. The other feeder hoppers supply the abrasive media which are mixed with the articles during centrifugal deburring.

It is common, in the art, to use two distinct abrasive media, one of which may be recovered and reused, and the other of which (e.g. silicon carbide) cannot be used again. The number of hoppers can be varied to suit particular needs, and any number of such hoppers is within the scope of this invention.

FIG. 3 also shows conveyor 73. The conveyor is driven by a conventional motor, the motor being connected to an encoder. The motor and encoder are indicated symbolically by reference numeral 75. The conveyor moves barrels from filling station 63, to the location at which handler 51 can transport them to the deburring units, or to the dumping station. The latter location is more apparent in FIG. 4.

FIG. 4 is a plan view of the system of the present invention. Centrifugal deburring units 101 and 102 are shown, each having two barrels 103. Handler 51 is shown to the left of dumping station 59. Batch hopper 65 is visible, together with feeder hoppers 67, 69, and 71. Elevators 67a, 69a, and 71a deliver articles and abrasive media to the respective hoppers. The elevators can be of any conventional design. Conveyor 73 is also shown in FIG. 4.

Dumping station 59 is located directly above a conventional apparatus for recovery of the deburred articles. The articles must be separated from the abrasive media, and the reusable and non-reusable media must also be separated from each other. Apparatus for performing this separation is well known in the art. It is common to use a plurality of shaker tables, which can take the form of screens of varying mesh sizes. One such table is indicated by reference numeral 83, in FIG. 4.

Chutes 77, 79, and 81, carry the sorted articles and abrasive media, respectively, out of the apparatus. The separated articles can be delivered from the system by outlet chute 85. Because the separation process usually includes flushing the parts with water, the separated parts are then delivered to a dryer, and the water is allowed to leave the system through appropriate drainage means. The parts separation apparatus, and the parts dryer and drainage means, are conventional, and are not part of the present invention. Any suitable equivalent means can be used with the system.

In FIG. 4, reference numerals 1, 2, 3, 4, and 5 designate the five equally-spaced positions at which barrels can be placed during the operation of the system. Motor 75 of conveyor 73 is reversible, so that barrels can be freely transported back and forth among these positions.

Position 1 is a "standby" position. It is located beyond batch hopper 65, and, in the embodiment shown, directly below feeder hopper 69. The standby position is intended as a temporary resting place for a barrel which has been filled with articles which have not yet been deburred. The proximity of Position 1 to feeder hopper 69 is only coincidental; the feeder hopper feeds material only through the batch hopper.

Position 2 is located directly beneath batch hopper 65, and is the loading position for a barrel.

Position 3 is the symbolic "center" of the apparatus, since it is located at the intersection of conveyor 73 and track 49. This is the location at which the handler can pick up a barrel, for transportation to the deburring units, or to the dumping station.

Positions 4 and 5 are temporary resting positions for barrels of deburred articles. These positions will be explained more fully in the description of the operation of the system.

Figure 5:
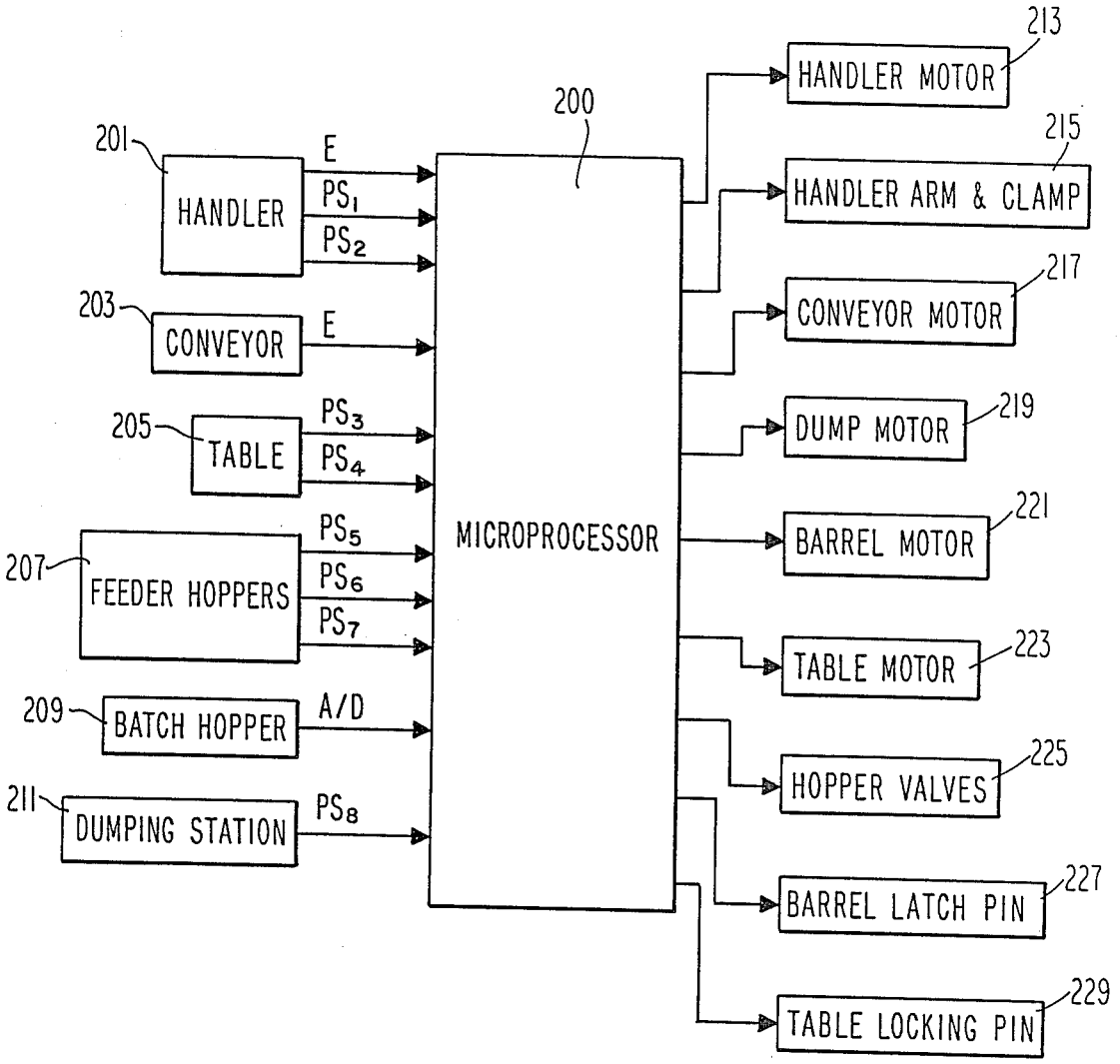
FIG. 5 is a block diagram showing the microprocessor which controls the system of the present invention, and showing the sensors which supply information to the microprocessor, and the principal components which are automatically controlled.

FIG. 5 is a block diagram showing the microprocessor which controls the entire system. FIG. 5 shows the major sensors and switches which provide inputs to the microprocessor, and also shows the major components controlled by the microprocessor.

As shown in FIG. 5, block 201 represents the handler, which provides at least three inputs to microprocessor 200. The output of the handler includes the signal from the encoder (labeled "E" in FIG. 5), which indicates the position of the handler along the track. Handler outputs $PS_1$ and $PS_2$ represent the output of proximity switches on the handler arms and handler clamps. The proximity switches indicate when the arms are fully extended, and whether the clamps have grasped a barrel. It is understood that sensing means other than proximity switches can be used. It is also understood that additional sensors can be used for more precise operation; FIG. 5 is intended only to symbolize the major lines of control.

Block 203 represents the conveyor, which has an output designated as "E". This symbol means that the output comes from an encoder, which signals the position of the conveyor, to the microprocessor.

Block 205 represents the table. There are two outputs shown. One of these, depicted as $PS_3$, indicates a proximity switch associated with the table locking pin. The other, depicted as $PS_4$, indicates a proximity switch associated with the latch pin. The comments made above, concerning the proximity switches, apply here and throughout the following description.

Block 207 represents the three feeder hoppers. There are three outputs, shown as $PS_5$, $PS_6$, and $PS_7$. These proximity switches, or other means, indicate, to the microprocessor, the condition (open or closed) of the valves which open and close the hoppers.

Block 209 represents the batch hopper. The batch hopper is equipped with a weighing means, and an analog to digital converter (indicated as "A/D"), to inform the microprocessor of the current weight of the contents of the batch hopper. Any other equivalent means can be used to monitor the weight of the contents of the batch hopper.

Block 211 represents the dumping station. Its output, represented by proximity switch $PS_8$, signals the condition of the dumping mechanism.

Block 213 represents the handler motor. The motor is controlled by the microprocessor, and is capable of operating in two directions, so that the handler can roll back and forth along the track.

Block 215 represents the handler arm and the handler clamp, both of which are controlled by signals from the microprocessor. The clamp, or its equivalent, is what actually engages flange 43 of barrel 103.

Block 217 represents the conveyor motor, as controlled by the microprocessor. This motor is capable of movement in both directions, so that the conveyor can move barrels back and forth among the various positions. In the preferred embodiment, this motor is also equipped with a dynamic brake, which is actuated by another control line (not shown) from the microprocessor. The brake prevents the conveyor from "overshooting" the desired stopping point.

Block 219 represents the dump motor, also controlled by the microprocessor. The dump motor can be of any conventional design, and simply inverts a full barrel onto a shaker table, or other separation system, as described above.

Blocks 221 and 223 represent the motors which rotate the barrel and table. As stated above, these motors are operated independently by the microprocessor. Both motors are capable of operating in both directions, and both motors include speed controls, in addition to an on-off switch. All of these controls are symbolized by the single control line shown in FIG. 5.

Block 225 represents the valves on the feeder hoppers and batch hoppers. The microprocessor opens and closes these valves to control the loading of the batch hopper, and to cause the contents of the loaded batch hopper to pour out into the barrel below.

Blocks 227 and 229 represent the latch pin and the locking pin for the barrel and table, respectively. The latch pin is extended and retracted, as described above, to secure the barrel to the table. The locking pin is extended to secure the table in one of its resting positions.

It is understood that the microprocessor can be replaced by another kind of computer, or even by a mechanical or electromechanical means. The sensors and switches could also be replaced by similar equivalents. All such variations are intended to be within the scope of the invention.

The operation of the invention will now be described, with reference to the schematic diagrams of FIGS. 6A–6O. Each of these diagrams symbolically represents the five positions along the conveyor, labeled as 1, 2, 3, 4, and 5. The circles represent the actual barrel positions. An empty circle means that no barrel is present. A shaded circle indicates the presence of a barrel at that position. The circles at the right indicate the barrel positions in one of the centrifugal deburring units. For simplicity, only one such deburring unit (unit 102 of FIGS. 3 and 4) is shown. The barrel positions on the deburring unit are labeled as A and B. The schematic diagrams also label the dumping station as D.

Figure 6A:
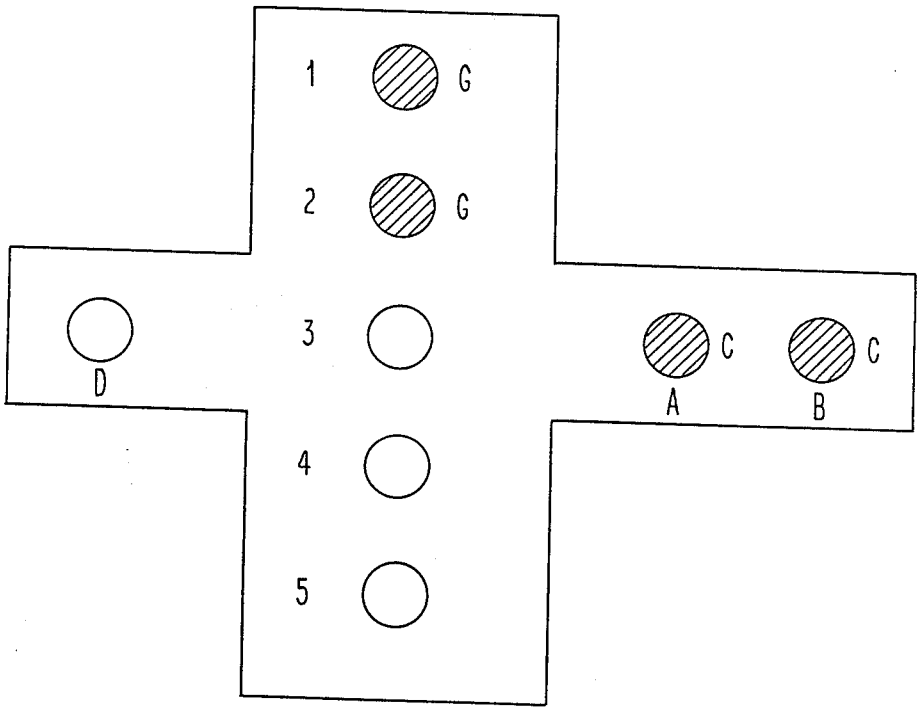
FIGS. 6A–6O are a series of schematic diagrams showing the movement of barrels through the present system, and illustrating the operation of the invention.

In FIGS. 6A–6O, the status of the contents of a barrel is indicated by a letter to the right of the barrel symbol. The letter "G" indicates that the barrel is a "green" barrel, i.e. a barrel which is filled with articles which have not yet been deburred. The letter "C" indicates that the barrel is a "completed" barrel, i.e. filled with parts which have been deburred. The terms "green barrel" and "completed barrel" are used throughout the following description, with these meanings.

The letter "E" indicates an empty barrel. The presence or absence of arrows, near the deburring unit, indicates whether that unit is rotating. The handler is not shown in these schematic diagrams, but it is assumed that the handler starts from a "home" position (not indicated on the schematic diagrams), and that it can move along its track to the desired location.

FIG. 6A shows the initial configuration of the system. (A descritpion of how the system is placed into this initial configuration will be given later.) As shown in the diagram, there are four barrels in the system. There are barrels in Positions 1 and 2, both filled with unprocessed articles. There are barrels in Positions A and B of the deburring unit which are filled with articles that have just been deburred. The deburring unit is not rotating.

The microprocessor now causes the handler to move from the "home" position to Position A, i.e. directly above one of the completed barrels. If the latch was not released as the barrel was last brought to a stop, the microprocessor causes the latch to release the barrel, by rotating the barrel briefly, as described above.

Figure 6B:
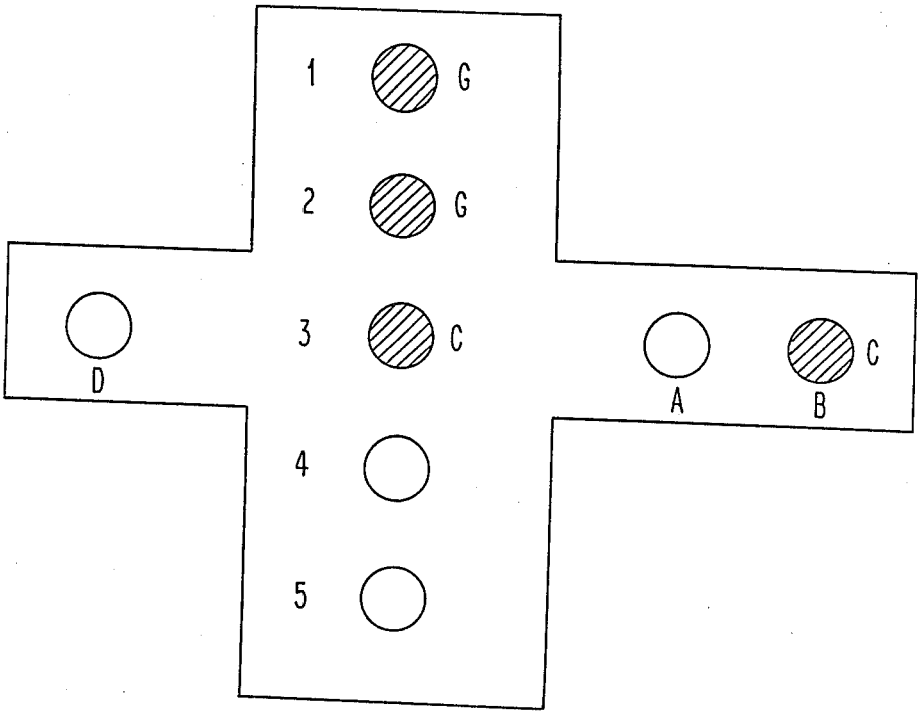

When the barrel is unlatched, the handler lowers its arms and clamps around a flange of the barrel. The microprocessor then commands the latch to release the barrel. The handler lifts the barrel from the deburring unit, and moves from Position A to Position 3, i.e. over the conveyor. The handler then lowers the barrel onto the conveyor, at Position 3, and raises its arms, away from the barrel. The configuration of barrels is now as shown in FIG. 6B.

Figure 6C:
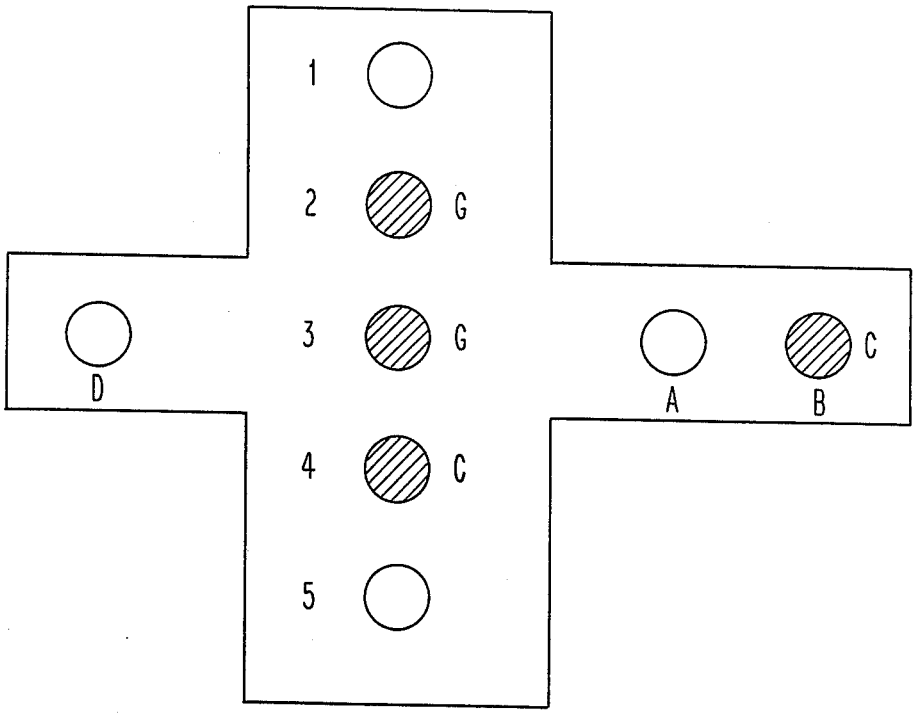

The microprocessor now causes the conveyor to move such that the barrels are advanced by one position. The result is the configuration of FIG. 6C.

Figure 6D:
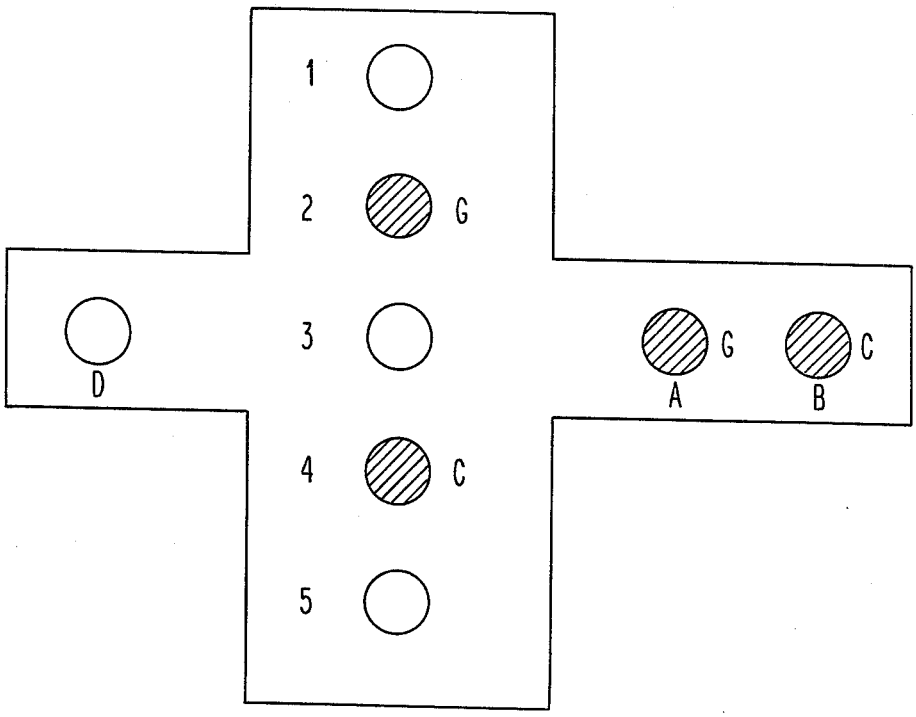

The handler is now located directly above a green barrel. Under the control of the microprocessor, the handler lowers its arms, picks up the barrel in Position 3, moves to Position A, and sets the green barrel onto the deburring unit. The configuration is now as shown in FIG. 6D.

Figure 6E:
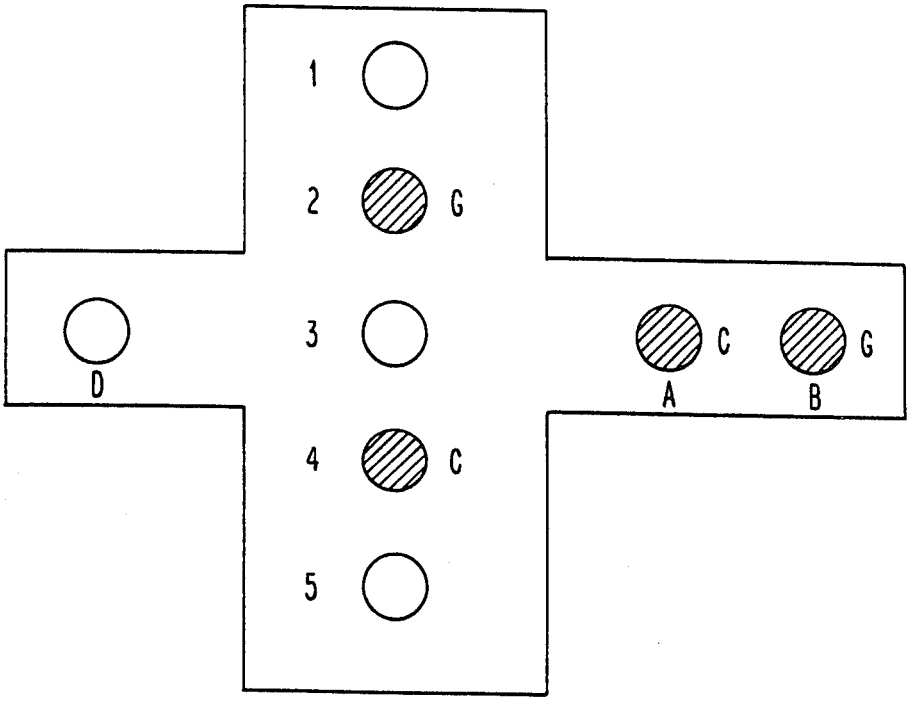

The microprocessor now causes the table, of the deburring unit, to rotate by 180°, such that the completed barrel is in Position A, and the green barrel is in position B. This configuration is shown in FIG. 6E. The microprocessor uses the proximity switch and table locking pin, and motor 13, all described above, to control the rotation of the table.

Figure 6F:
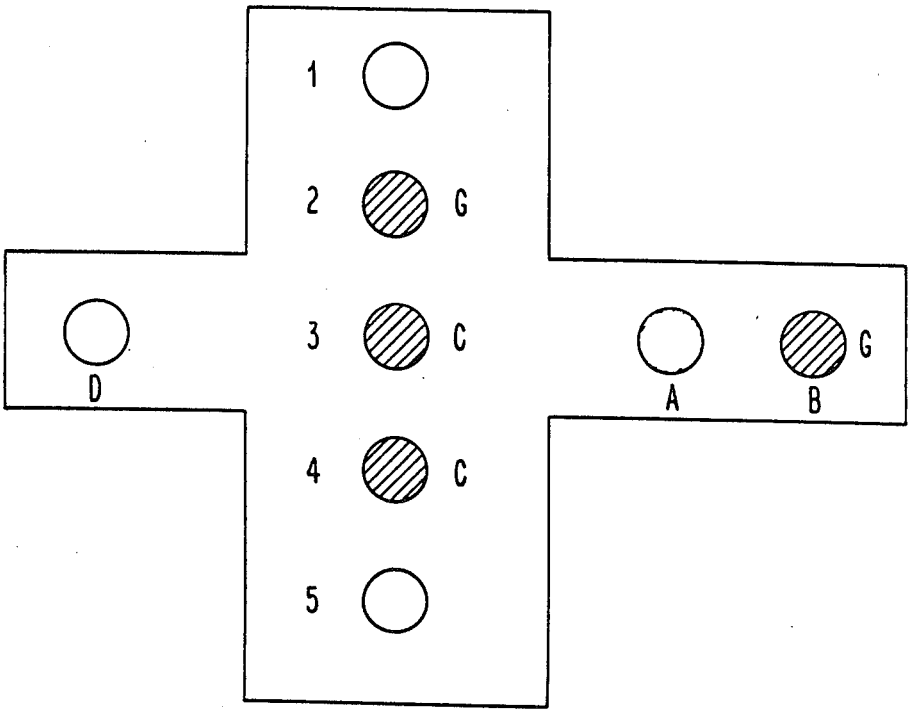

The handler, which has been waiting above Position A while the table was rotated, now lowers its arms, and picks up the completed barrel in Position A. The handler then moves to Position 3, and sets the barrel down onto the conveyor. The configuration is now as shown in FIG. 6F.

Figure 6G:
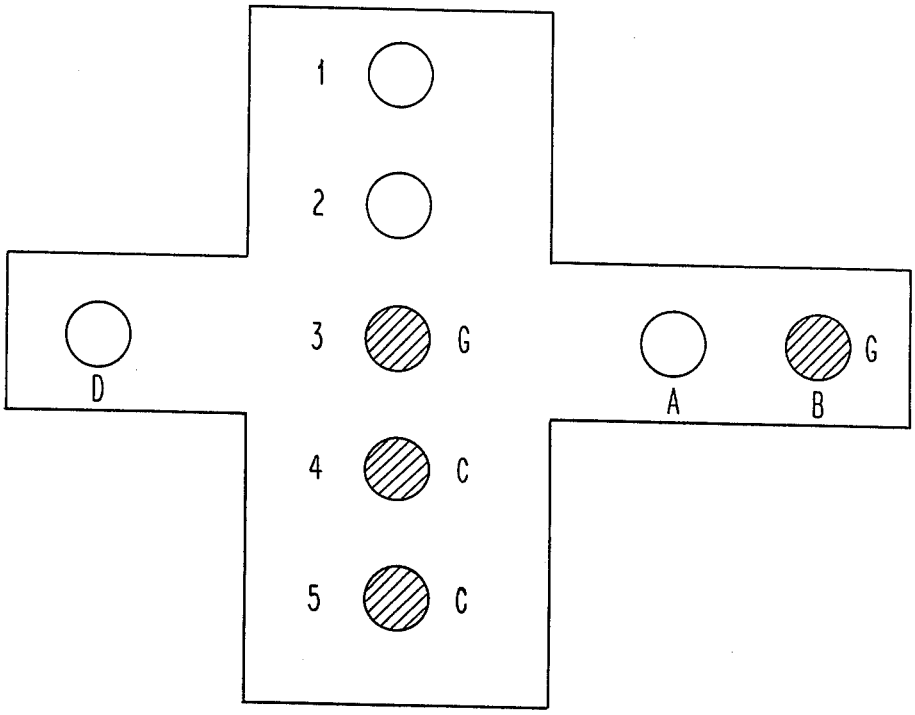

The microprocessor now causes the conveyor to move, so that the barrels are displaced by one position, as shown in FIG. 6G. A green barrel is now in Position 3.

Figure 6H:
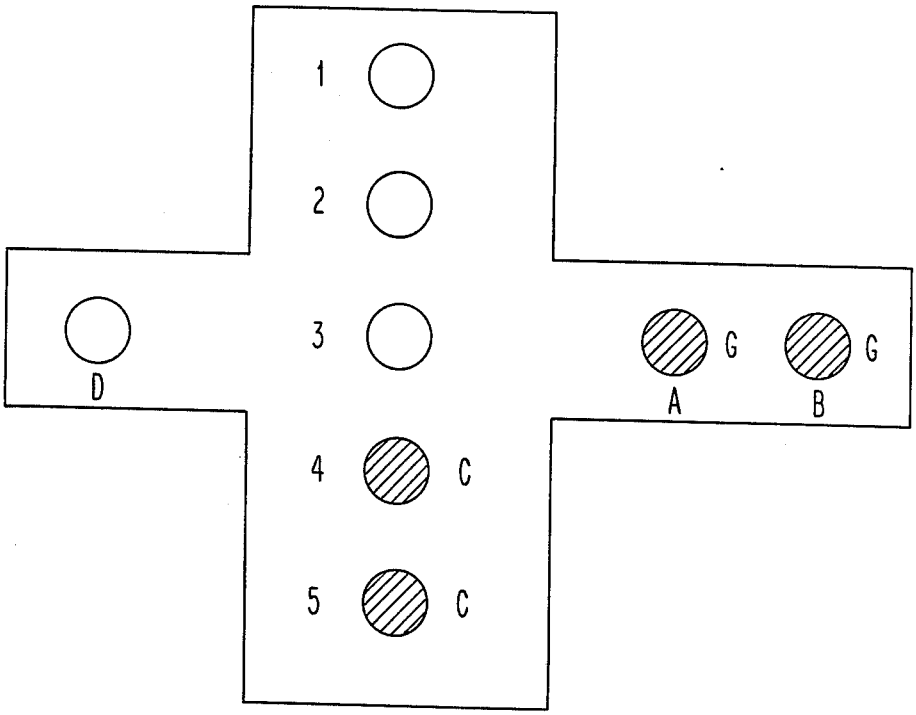

The handler now lifts the green barrel from Position 3, and moves it to Position A, on the deburring unit. The handler then returns to the "home" position. The result is as shown in FIG. 6H. There are two green barrels in the deburring unit, and there are completed barrels in Positions 4 and 5, on the conveyor.

The microprocessor causes the latches to close. As explained above, this is done by extending the latch pin briefly, and rotating the barrel slowly, either in the main direction, or in the opposite direction (depending on which alternative, described above, is chosen). In either case, the latch pin is retracted, and the barrel is made to begin rotation in the main direction. The microprocessor then actuates the table motor, causing the table to rotate in a direction opposite to that of the barrel.

While the deburring unit is rotating, the system continues to process the other barrels, as explained below.

Figure 6I:
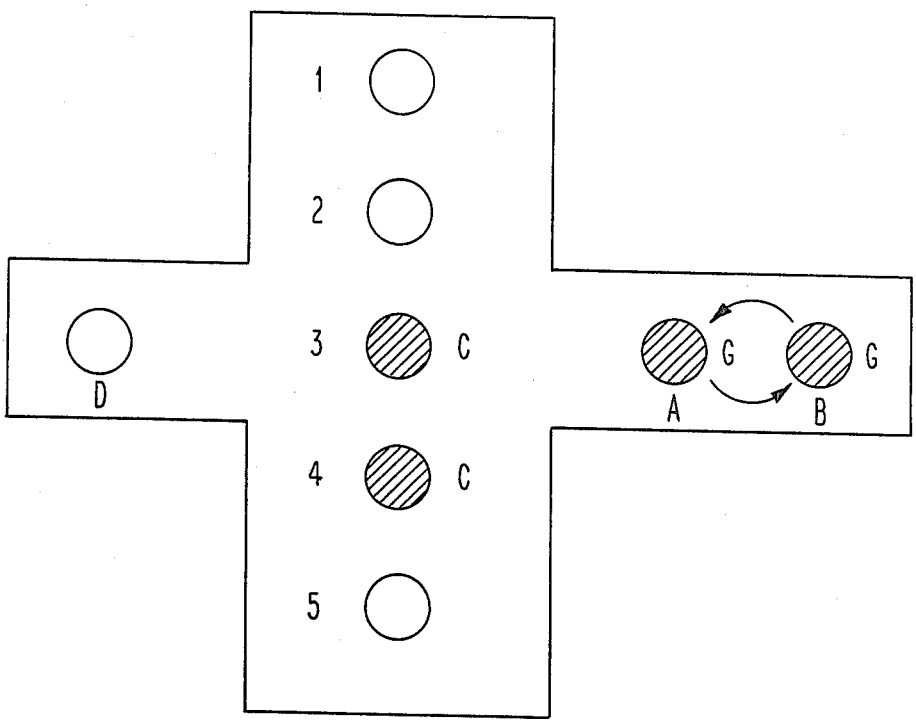

While the deburring operation proceeds, the microprocessor causes the conveyor to move the barrels back by one position. The configuration is now as shown in FIG. 6I. Note the arrows indicating that the table is rotating and that the deburring unit is operating.

Figure 6J:
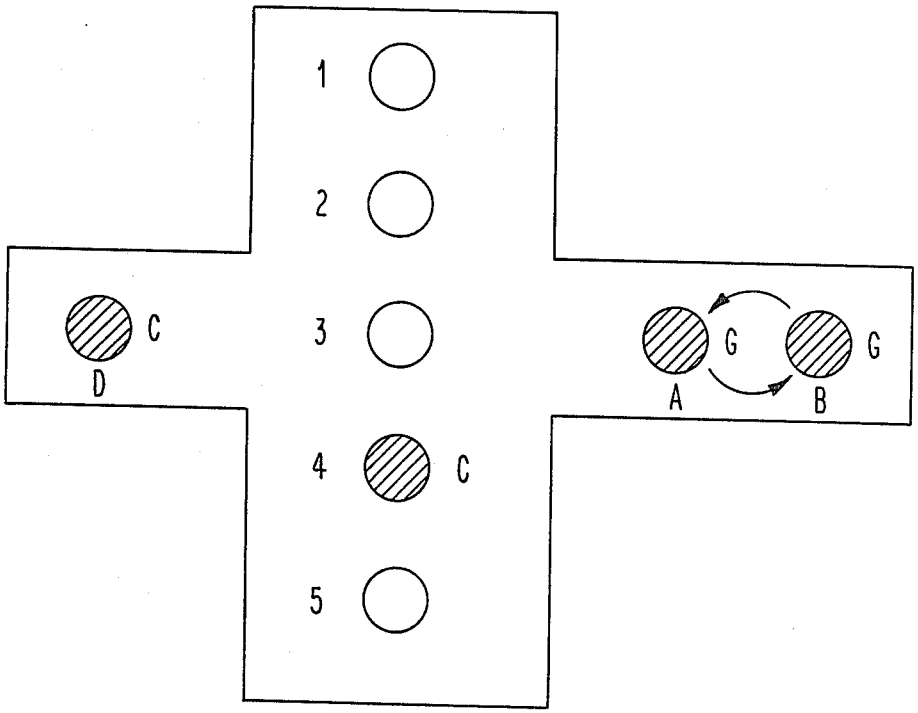
Figure 6K:
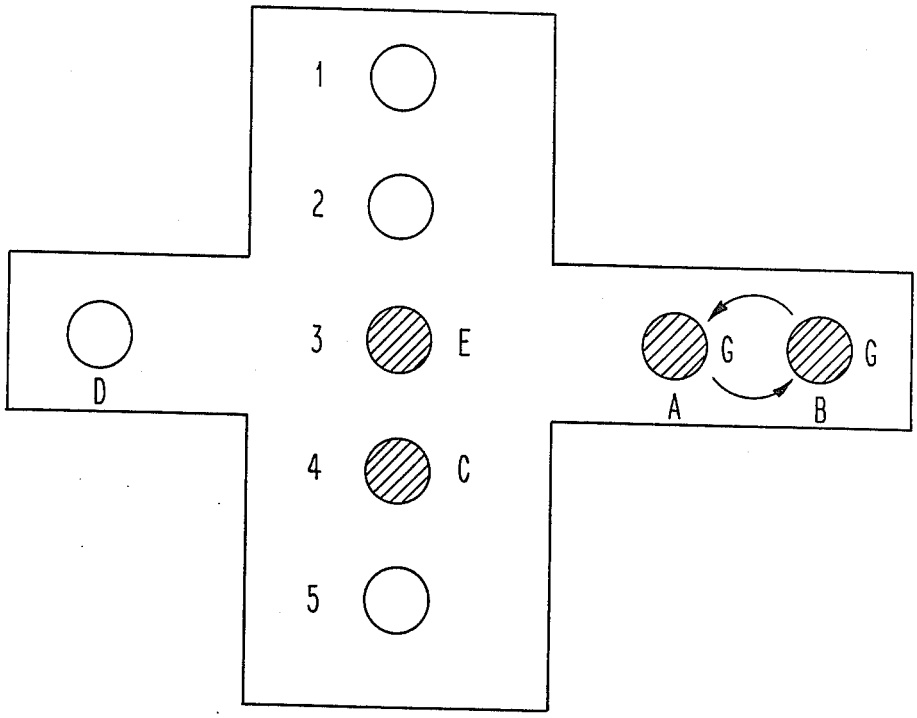

The handler now lifts the completed barrel from Position 3, and carries the barrel to the dump station, at Position D. The configuration is now as shown in FIG. 6J. The dumper engages the barrel, and the contents of the barrel are removed. The handler then lifts the emptied barrel, and transports it back to Position 3 on the conveyor. The resulting configuration is as shown in FIG. 6K.

Figure 6L:
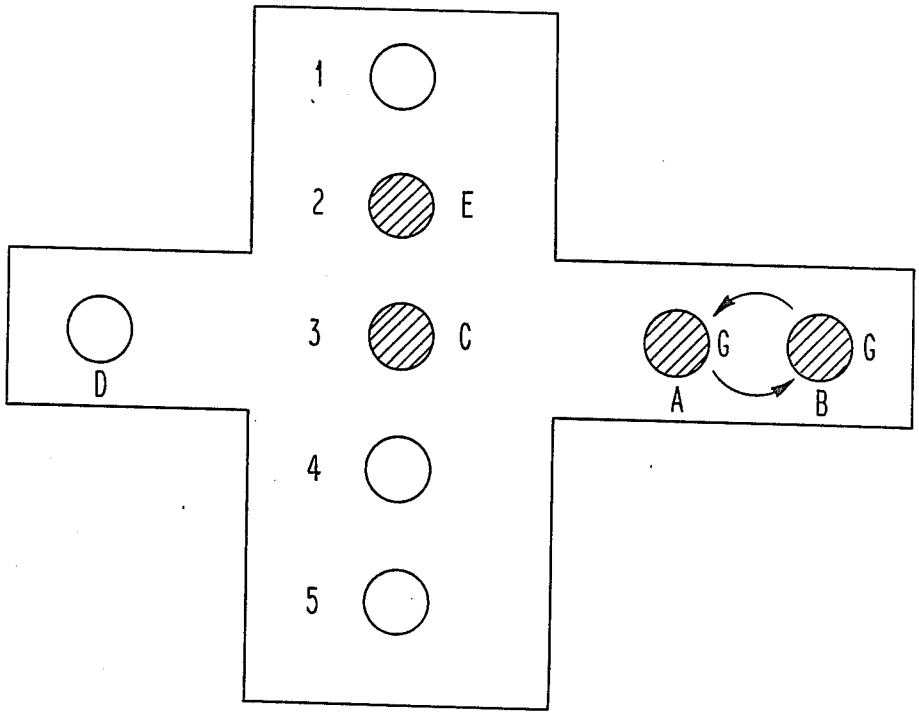

The microprocessor now causes the conveyor to move back by one position, so that the completed barrel in Position 4 is now in Position 3, and the empty barrel is in Position 2. The configuration is now as shown in FIG. 6L.

The filling operation now begins. The microprocessor closes the discharge valve, located at the bottom of the batch hopper, and operates another valve which directs a small quantity of water, on the order of several gallons, into the hopper. This water cushions the discharge valve while the articles are being poured in. The water may be drawn from a suitable tank, with a conventional float valve mechanism, or equivalent. The hopper is then weighed, so that the weight of the materials subsequently added can be determined.

A first abrasive medium, which may be reusable, is directed from one of the feeder hoppers, into the batch hopper. The microprocessor closes a valve on the feeder hopper when a predetermined weight has been reached. Note that all weighing is done while the material is in the batch hopper. No weighing is done when the materials are in the barrel.

A second abrasive medium, such as silicon carbide, is similarly directed into the batch hopper, followed by the articles to be deburred. The weight of the batch hopper is continuously monitored, and the microprocessor closes the valves on the respective feeder hoppers when the desired weights are attained. Finally, the water valve (not shown in the figures) opens, allowing a predetermined quantity of water, by weight, into the batch hopper. The amount of water added depends on the size of the barrels, and is typically in the range of 30–50 gallons.

The discharge valve then opens, allowing the contents of the batch hopper to fall into the barrel below. When the articles have been dumped into the barrel, and with the discharge valve on the batch hopper still open, a small quantity of water, of the order of five gallons, is directed into the batch hopper, and into the barrel. This extra water cleans the barrel of residual articles and abrasive media. This water must be taken into account in computing the total amount of water that is added to the barrel.

A cathode ray tube, or other indicating device, can be provided for showing the progress of the filling operation. If the programmed weights are not achieved, the indicator can signal that the system needs maintenance, and the system can also be programmed to stop automatically. Such a shutdown might be necessary if there are insufficient parts and/or abrasives in the hoppers, or if water failed to enter the hopper as desired.

It is understood that different combinations and weights of water, articles, and abrasive media can be used with this invention. The system can be programmed to load a variety of combinations of articles and abrasives into a barrel, and to move the barrels through the system. It is necessary only that the microprocessor, or other control means, be programmed to wait until the filling operation is completed, before moving the barrels again.

Figure 6M:
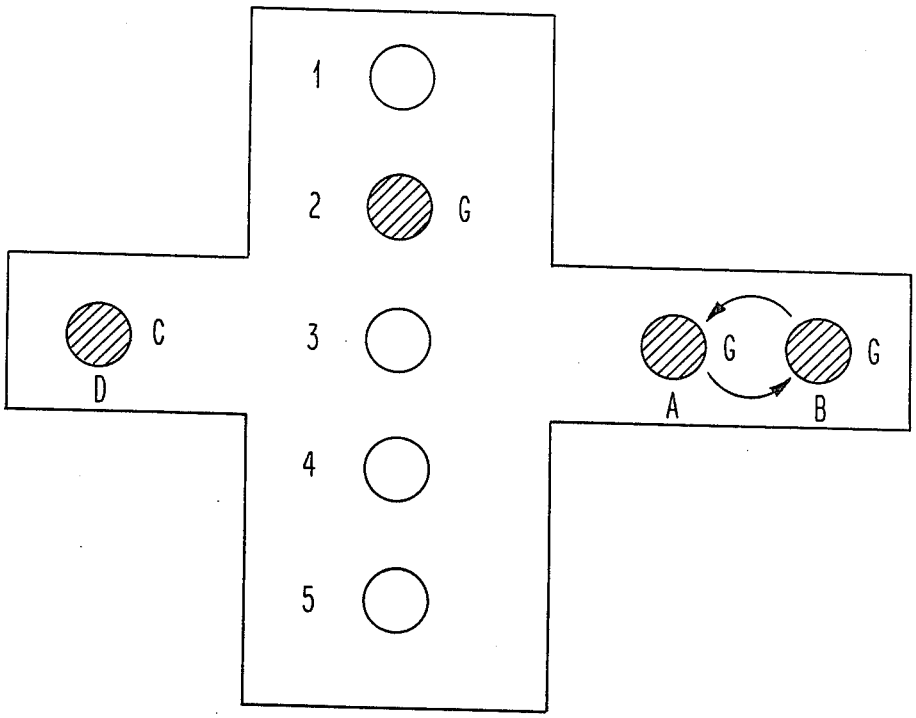

After the filling operation is complete, the handler is directed by the microprocessor to transport the completed barrel from Position 3 to the dumping station. The result is the configuration shown in FIG. 6M. Alternatively, the completed barrel can be transported to the dumping station while the filling operation is in progress (and, of course, while the deburring unit is still rotating). Note that FIG. 6M shows a green barrel in Position 2, which is the result of the filling operation.

Figure 6N:
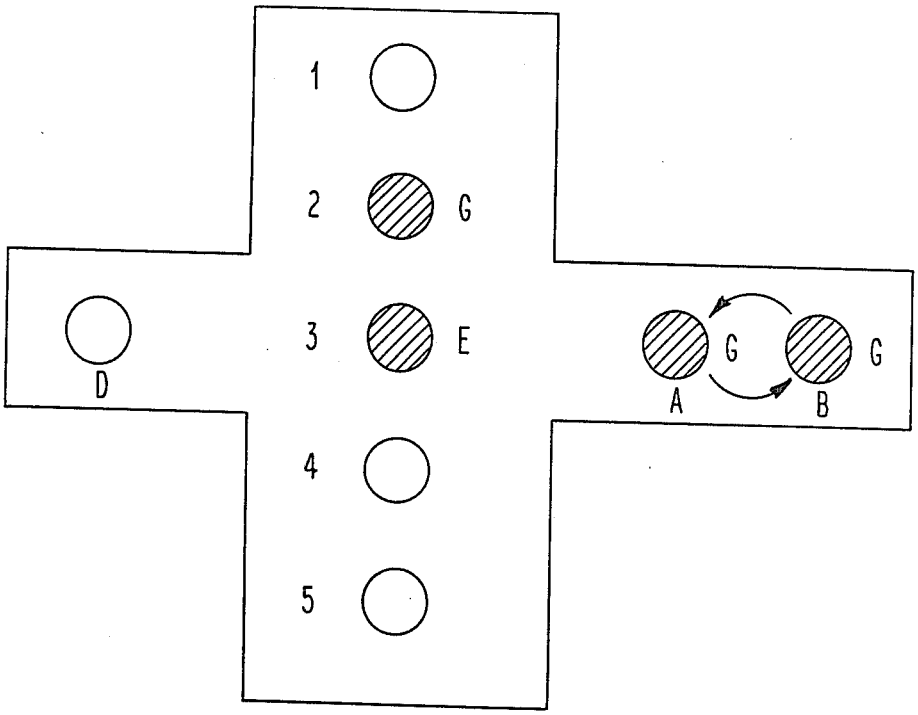
Figure 60:
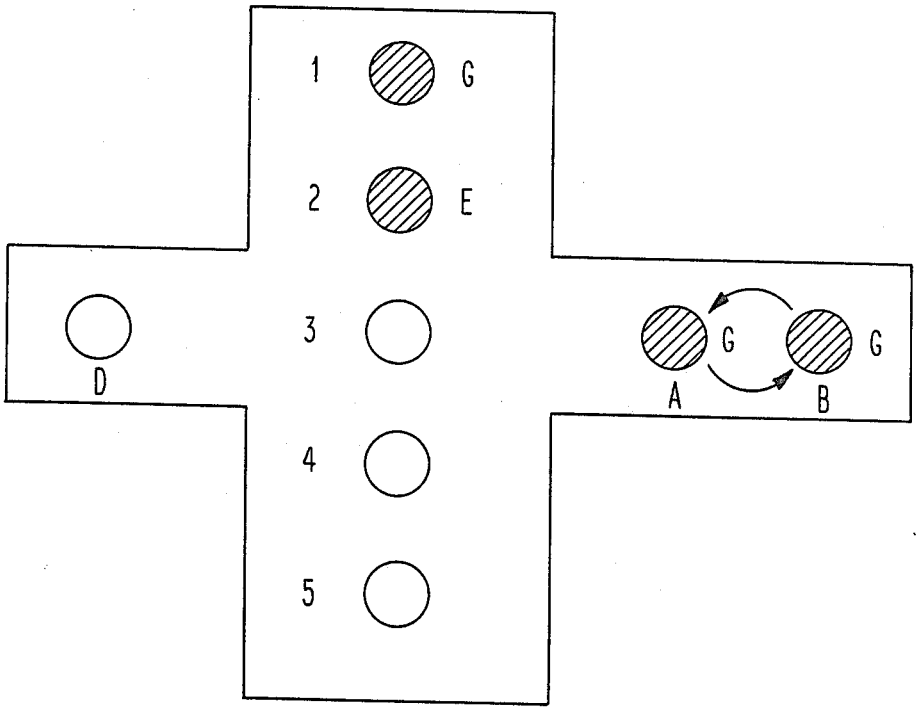

After the completed barrel is dumped, it is transported by the handler back to Position 3. The configuration is now as shown in FIG. 6N.

The microprocessor causes the conveyor to move back by one position, such that the empty barrel is located at Position 2, as shown in FIG. 6O. The green barrel is now located at Position 1. The filling operation is repeated, causing the barrel in Position 2 to be filled. Also, the deburring unit completes its rotation, the microprocessor using an internal clock to determine when the desired time interval has elapsed. When the filling operation is complete, and the deburring unit comes to rest, the system will have green barrels in Positions 1 and 2, and completed barrels in Positions A and B. This is exactly the configuration of FIG. 6A, which proves that the cycle is complete.

As stated above, the description of the system operation has included only one deburring unit. However, the operation of two deburring units is very similar. The movements of the handler and conveyor will be virtually the same for the other deburring unit, except that the direction and distance of travel, for the handler, are slightly different. The microprocessor can easily be programmed to accommodate the use of two deburring units. The operations of the deburring units are staggered in time, so that the handler, conveyor, and filling station can load and unload the second deburring unit while the first unit is still spinning. Except for the slight modification of programming, and the staggered operation of the deburring units, the operation of the system remains the same as described above.

Note that only Positions 2 and 3, along the conveyor, are used for actual operations. Placing a barrel in Position 2 allows it to be filled. Placing the barrel in Position 3 allows it to be raised by the handler. Positions 1, 4, and 5 are used solely as temporary storage locations, i.e. positions where a barrel rests while another barrel is being filled or carried to the deburring unit, or to the dumping station.

As mentioned above, the system must be placed into the configuration shown in FIG. 6A, before beginning the cycle described. The microprocessor can be programmed to perform this initializing routine. The sequence of operations is described in the following paragraphs. The description includes only one centrifugal deburring unit, although two or more such units can be included, with a suitable modification to the programming.

It is first assumed that there are four empty barrels in the system, located at Positions 2, 3, A, and B. The automatic filling cycle, described above, is activated, so that the barrel in Position 2 is filled. The conveyor is then moved, so that the filled barrel is in Position 1, and an empty barrel is now in Position 2. The filling cycle is repeated for the empty barrel. There are now filled barrels in Positions 1 and 2.

The handler then moves to the centrifugal deburring unit, lifts the empty barrel from Position A, and transports it to Position 3 on the conveyor. The conveyor then moves by one position, so that the empty barrel is now at Position 4, and a full barrel is at Position 3. The handler lifts the full barrel from Position 3, and transports it to Position A of the deburring unit.

The handler then moves to Position B, lifts the empty barrel, and brings it to Position 3 on the conveyor. The conveyor then moves, such that the empty barrel in Position 3 is shifted to Position 4. A full barrel is now in Position 3, and the other empty barrel is in Position 5. The handler lifts the full barrel from Position 3, and transports it to Position B in the deburring unit. The latches are closed. The motors of the deburring unit are actuated, and the barrels and the table begin to rotate.

While the deburring unit is rotating, the conveyor moves by two positions, so that the empty barrels in Positions 4 and 5 are transported to Position 2 and 3, respectively. The filling operation is activated, so that the barrel in Position 2 is filled. The conveyor then moves by one position, so that the filled barrel is in Position 1, and the empty barrel is in Position 2. The filling operation is repeated. When the deburring unit has rotated for the desired period of time, the unit is turned off, and the configuration of the system is as shown in FIG. 6A.

It is understood that the initialization sequence, described above, can be varied, depending on the initial locations of the barrels. If empty barrels are located, for example, in Positions 1, 2, 3, and 4, the microprocessor could still be programmed to operate the conveyor, handler, and filling mechanism, so as to bring the system to the configuration of FIG. 6A. Such alternative programming sequences are within the scope of this invention.

The speed of operation of the system is governed mainly by the time required to debur the articles, which varies with the nature of the articles. Typically, the articles are spun in the deburring device for about 20–30 minutes. The automated loading and unloading of barrels, in the deburring unit, requires about 4–6 minutes. Therefore, the approximate total time between cycles is about 24–34 minutes. While this cycle is in progress, the completed barrels can be dumped and refilled. The latter process may take only about 5–6 minutes. As mentioned above, the capacity of the system is greatly enhanced when two deburring units are used. Because the time needed for the complete cycle is of the order of 20 minutes, it is feasible to use two deburring units, each having two or more barrels, with staggered timing. Neither unit will interfere with the operation of the other.

The present invention is a dramatic improvement over the prior art. The period during which one of the deburring units is not operating, between cycles, is only of the order of 2 minutes. In the prior art, it is often necessary to wait an hour before the deburring unit can be run again.

While the invention has been described with respect to a specific embodiment, it is understood that other variations are possible, within the scope of the disclosure. As indicated above, the programming of the microprocessor can be altered to accommodate different initial configurations, or to accommodate different numbers of deburring units and barrels. Also, the sensors and controls, used by the microprocessor, can be replaced with equivalent devices. The system does not need a microprocessor; if desired, it could be operated under manual control. These and other similar modifications should be deemed within the spirit and scope of the following claims.

What is claimed is:

1. A latch mechanism for a centrifugal deburring unit, the deburring unit having a barrel mounted for rotation, about its axis, on a table, the barrel having a flange, the latch mechanism comprising a pilot latch member, and a plurality of secondary latch members, the latch members being connected to the table, the pilot latch member and the secondary latch members being connected to each other by a linking means, the pilot latch member being shaped to engage a retractable latch pin mounted on the table, wherein the latch members are simultaneously rotatable into an open or closed position, when the latch pin engages the pilot latch member, wherein the latch members engage the flange, in the closed position, and wherein the latch members do not engage the flange, in the open position.

2. The latch mechanism of claim 1, wherein each of the secondary latch members comprise a generally rectangular member, and wherein the pilot latch member includes a protrusion shaped for engagement with the latch pin.

3. The latch mechanism of claim 2, wherein all of the latch members are beveled, so that the latch members do not touch the barrel, when they are in the open position.

4. The latch mechanism of claim 3, further comprising means for raising and lowering the latch pin, wherein the latch members can be engaged and disengaged from the flange according to the position of the latch pin and the direction of rotation of the barrel.

5. The latch mechanism of claim 1, further comprising means for raising and lowering the latch pin, wherein the latch members can be engaged and disengaged from the flange according to the position of the latch pin and the direction of rotation of the barrel.

6. Apparatus for deburring of articles, comprising:

(a) at least two barrels, the barrels being capable of holding the articles to be deburred, (b) a table, the table having rotating members, the barrels being insertable into the rotating members, the rotating members and the barrels being rotatable relative to the table, (c) first gear means for causing the rotating members to rotate, (d) second gear means for rotating the table, the second gear means being independent of the first gear means, and (e) latch means for securing the barrels to the table, wherein the barrels are removable from the table when the latch means is released, wherein the latch means comprises a pilot latch member, and a plurality of secondary latch members, the pilot latch member and the secondary latch members being connected by a linking means, the pilot latch member being shaped to engage a retractable latch pin mounted on the table, wherein the latch members are simultaneously rotatable when the latch pin engages the pilot latch member, and wherein the latch means is automatically opened and closed by the position of the latch pin and by the rotation of the barrel.

7. Apparatus for centrifugal deburring of articles, comprising a table, the table having at least one rotating member capable of holding a container of the articles to be deburred, the table and the rotating member being independently rotatable, and latch means for releasably securing the container on the table, wherein the latch means comprises a pilot latch member, and a plurality of secondary latch members, the pilot latch member and the secondary latch members being connected by a linking means, the pilot latch member being shaped to engage a retractable latch pin mounted on the table, wherein the latch members are simultaneously rotatable when the latch pin engages the pilot latch member, and wherein the latch means is automatically opened and closed by the position of the latch pin and by the rotation of the barrel.

* * * * *